United States Patent [19]

Meilleur

[11] Patent Number: 4,742,659

[45] Date of Patent: May 10, 1988

[54] MODULE SECTIONS, MODULES AND FORMWORK FOR MAKING INSULATED CONCRETE WALLS

[75] Inventor: Serge Meilleur, Beauport, Canada

[73] Assignee: Le Groupe Maxifact Inc., Brossard, Canada

[21] Appl. No.: 32,523

[22] Filed: Apr. 1, 1987

[51] Int. Cl.[4] ..... E04B 2/32

[52] U.S. Cl. ..... 52/309.12; 52/426; 52/562

[58] Field of Search ..... 52/309.2, 309.12, 426, 52/561, 562, 563, 564, 565

[56] References Cited

U.S. PATENT DOCUMENTS

| | | | |
|---|---|---|---|
| 1,294,224 | 2/1919 | Bellingham | 52/563 |
| 1,302,728 | 5/1919 | Thomas | 52/563 |
| 2,888,820 | 6/1959 | Sanford | 52/565 |
| 4,229,920 | 10/1980 | Lount . | |
| 4,516,372 | 5/1985 | Grutsch | 52/309.12 |
| 4,604,843 | 8/1986 | Ott et al. . | |

FOREIGN PATENT DOCUMENTS

| | | | |
|---|---|---|---|
| 125336 | 4/1947 | Australia | 52/564 |
| 826584 | 11/1969 | Canada . | |
| 838601 | 4/1970 | Canada . | |
| 892329 | 2/1972 | Canada . | |
| 924922 | 4/1973 | Canada | 52/426 |
| 7600672 | 7/1977 | Netherlands | 52/426 |

OTHER PUBLICATIONS

Brochure Formibec Industries Ltd., "The Only Sensible Way to Build", undated.

*Primary Examiner*—John E. Murtagh

*Attorney, Agent, or Firm*—Bacon & Thomas

[57] ABSTRACT

A formwork is made up of a series of plastic foam modules disposed in the manner of a brick wall and forming a mold into which concrete is poured, the formwork remaining permanently secured to the concrete to produce a concrete wall insulated both on the inside and on the outside. Each module is formed of two identical sections disposed in mirror position. Each module section is a panel having inner spaced ribs which terminate short of the top and bottom panel edges and inserts are embedded in the ribs, having apertures opening in the free spaces formed by the ends of the ribs and the panel edges. Once the two identical module sections are placed in mirror position, at the construction site, they are held together by horizontal tie-rods having hooked ends lockingly engaged in the insert apertures. Adjoining tie-rods, in modules, disposed one over the other, are further interlocked by vertical coupling rods to prevent separation of the modules during pouring of the concrete. Reinforcement bar supports are fixed to these coupling rods, being bent at their ends to form troughs into which horizontal reinforcement bars may be lodged.

10 Claims, 5 Drawing Sheets

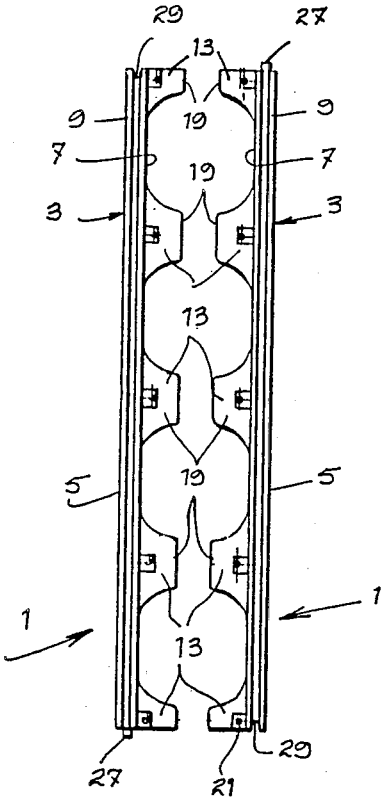
FIG. 1
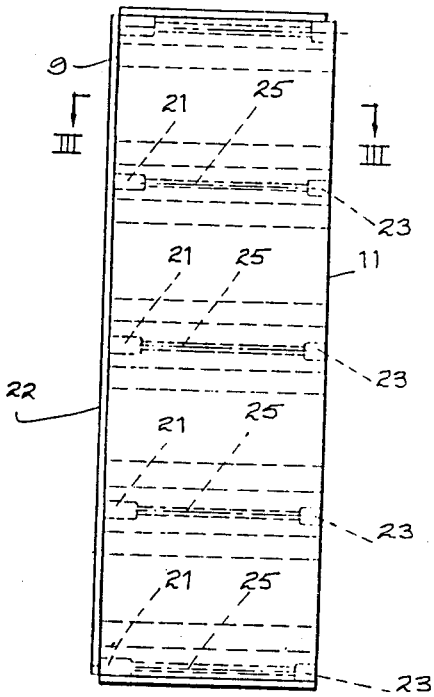
FIG. 2
FIG. 3
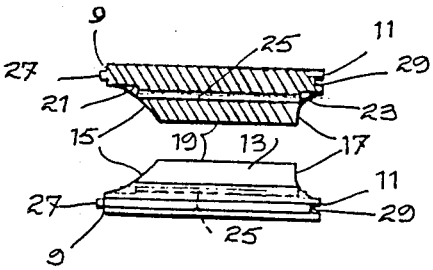
FIG. 3a
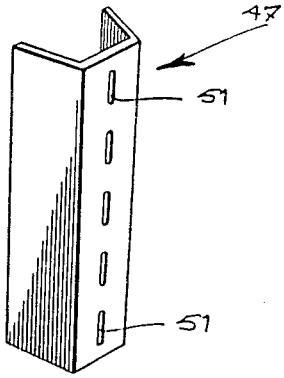
FIG. 8

MODULE SECTIONS, MODULES AND FORMWORK FOR MAKING INSULATED CONCRETE WALLS

BACKGROUND OF THE INVENTION

1. Field of the Invention

The present invention generally relates to the art of making a concrete wall which is insulated both on the inside and on the outside by using a formwork, made of foam plastic material such as expanded polystyrene, as a mold into which the concrete mix is poured, which mold is permanently secured to the concrete after the latter has set.

2. Description of the Prior Art

In present day practice, a formwork made of wood or metal panels held together in spaced parallel position by tie-wires and other appropriate connection means at their ends, is used to build a concrete wall. The formwork is expensive and its mounting and dismounting are time consuming and thus also costly. Furthermore, the resulting concrete wall is not insulated.

A formwork has already been proposed which is constituted by hollow modules fully made of insulating foam plastic material; the modules being disposed and stacked in the manner of a brick wall and concrete mix being thereafter poured into the assembled hollow modules acting as a mold which remain permanently secured to the concrete wall after the concrete has set. In this manner, not only is time being saved in setting up the formwork on site-appropriate tie-wires and tongue-and-groove joints being provided at the factory—but there is no time wasted in dismantling the formwork as in the old practice. Also, the very advantageous result is the production of a concrete wall which is fully and permanently insulated both on the inside and on the outside.

However, these known insulated formworks suffer severe drawbacks.

Indeed, because these modules are quite light, they tend to separate from one another by the pressure built by the concrete mix when being poured. Because of this, elaborate means must be provided, at the site and outside the formwork, to prevent such separation caused by lifting of the modules as the latter tend to float on the concrete mix, because of their lightness.

Also, the known formworks are built, as said above, from brick-like hollow modules molded in factory and formed of a pair of foam plastic panel-like sections held in space relationship by tie-wires or rods of which the ends are solidly embedded in the foam plastic, at the factory. The result is that a module is useful for making a concrete wall having only one predetermined thickness. It is therefore necessary for the manufacturer to keep a large inventory of modules of varying thicknesses to satisfy customers' demand.

SUMMARY OF THE INVENTION

It is therefore an object of the present invention to propose an improved formwork, of the above type, capable of avoiding the aforesaid drawbacks.

This is achieved, on the one hand, by manufacturing identical module sections as separate members rather than immediately connecting them two by two, at the factory, to produce complete modules; the required tie-wire or rod means being made and supplied separately. Appropriate provision has to be made, of course, on the module sections to receive the tie-wire means, but the latter are only applied on the construction site.

As will be gathered from the above, this procedure makes it possible to supply always the same module sections and separate tie-rods thereby appreciably reducing inventory since only the tie-rods need be of various sizes suited for the desired wall thickness. By the same token, volume is reduced so that less space is required for storage and transportation. This result is more specifically achieved by embedding inserts in the ribs of the module sections, to which reference is fully made hereinafter, which inserts have apertures into which hooked ends of tie-rods lockingly engage, thereby holding the module sections in appropriate lateral relationship to form modules.

Vertical coupling rods having hooked ends are, on the other hand, provided to interlock with tie-rods of stacked modules to prevent the latter from separating upward under the pressure built by the concrete mix when the latter is being poured. Thus, there is no need to provide any additional structure, on the site, to safely hold the modules in steady vertical position in relation to one another, thus preventing the above mentioned lifting action.

More specifically and according to one aspect of the invention, there is provided a formwork module section, made of foam plastic material, which is adapted to serve as one wall of a module of a formwork and which comprises a panel, spaced ribs solid with the panel and projecting from the panel inner face between the panel upper and lower edges, and inserts embedded, each in one of the ribs, the inserts being formed with tie-rod receiving-and-locking apertures; these apertures being located at the upper and lower ends of the ribs short of the panel upper and lower edges.

According to a preferred form, the inserts may be tubular members having hollowed ends opening at the ribs upper and lower ends; these hollowed ends defining the aforesaid tie-rod receiving-and-locking apertures. Alternatively, the inserts may be in the form of channel-shaped members having ends projecting beyond the ribs upper and lower ends; these members each having a central web formed with holes located in the projecting ends, these holes acting as the tie-rod receiving-and-locking apertures.

Another aspect of the invention is a formwork module which comprises a pair of formwork sections as defined above, these sections being disposed in mirror position and the formwork module further comprising tie-rods having hooked ends lockingly engaged into the insert apertures.

Still another aspect of the invention lies in a formwork for making an insulated concrete wall and comprising a pair of modules as defined above, which modules are stacked one upon the other with adjoining tie-rods disposed one above the other, in pairs, the formwork further having coupling rods with hooked ends, these hooked ends interlocking with the tid-rods of the aforesaid pairs for preventing vertical separation of the formwork modules as concrete is being poured into it.

Other object features and advantages of the invention will become apparent from the following description having reference to the appended drawings and given purely as an example as to how the invention may be put into practice.

BRIEF DESCRIPTION OF THE DRAWINGS

FIG. 1 is a top plan view of two module sections in their mirror position of use, while FIG. 2 is a side elevation view;

FIG. 3 is a cross-sectional view of one module section taken along line III—III of FIG. 2 while FIG. 3 is an end view likewise of a module section;

FIG. 8 is a perspective view of an insert member for the embodiment of FIG. 7;

DESCRIPTION OF THE PREFERRED EMBODIMENTS

Figure 4:
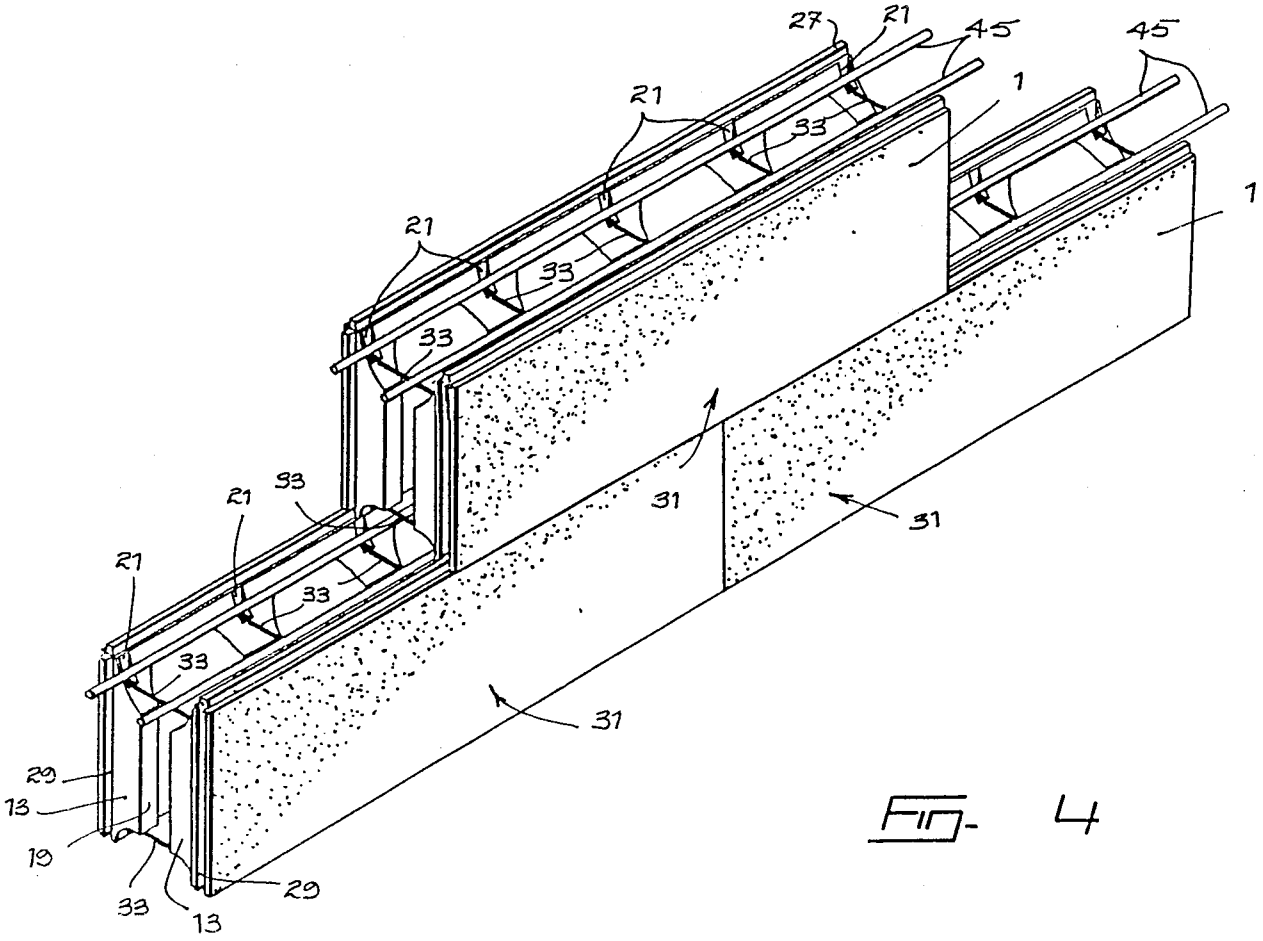
FIG. 4 is a perspective view of a formwork in the process of being erected, three modules being shown interconnected.

Referring to FIGS. 1, 2 and 3, there is shown two module sections 1 in their position of use, that is, in mirror position. Each section 1, made completely of foam plastic material as aforesaid, comprises a panel 3 having an outer flat face 5 and an inner flat face 7; an upper edge 9 and a lower edge 11. Elongated evenly spaced ribs 13 project from the inner flat face 7 between the edges 9 and 11 and their upper and lower ends 15 and 17 preferably slope from the panel edges 9 and 11 toward flattened tips 19 of the ribs 13, as shown in FIGS. 3 and 3A. At least part of each ends 15 and 17 of the ribs 13 forms a flat wall located short of the edges 9, 11, of the panel 3. This may be obtained by cutting appropriate notches 21 and 23 (FIGS. 3, 5) through the sloping ends 15, 17. One insert, in the form of a tubular member 25, is embedded in each rib 13, its hollowed end opening in the flat walls of the notches.

As shown, the ribs 13 preferably have vertical curved sides merging with the panel inner face 7 so that concrete mix poured in the mold formed by the two module sections 1 will produce a concrete column made up of a succession of rounded sections joined by narrow necks between the rib flat tips 19.

The module sections 1 are provided with conventional tongues 27 and grooves 29 for connection to adjoining modules 31, as illustrated in FIG. 4 where three modules 31 are shown interconnected. These tongue and groove joints of course prevent relative lateral displacement of adjoining modules 31 of the formwork. As mentioned previously, the modules 31 are laid in the same manner as bricks in a brick wall. They are rectangular in shape with appropriate overall dimensions being 16 inches in height and 48 inches in length; the thickness being variable as said before. As the formwork is being erected, horizontal reinforcing bars 33 may be laid in the mold under formation in a manner described below.

Figure 5:
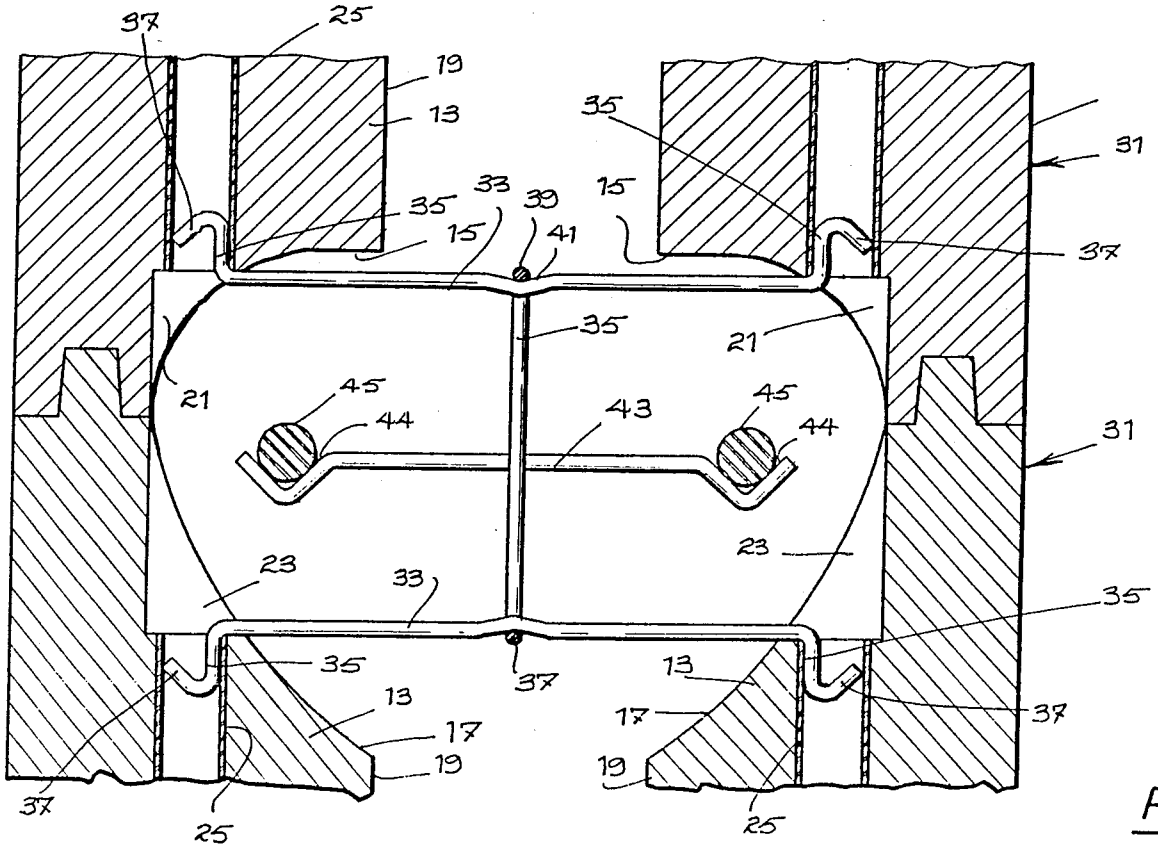
FIG. 5 is a vertical cross-sectional view of the ends of two interconnected stacked modules, view taken in a vertical plane containing two tie-rods, a coupling rod and a reinforcing bar support.
Figure 7:
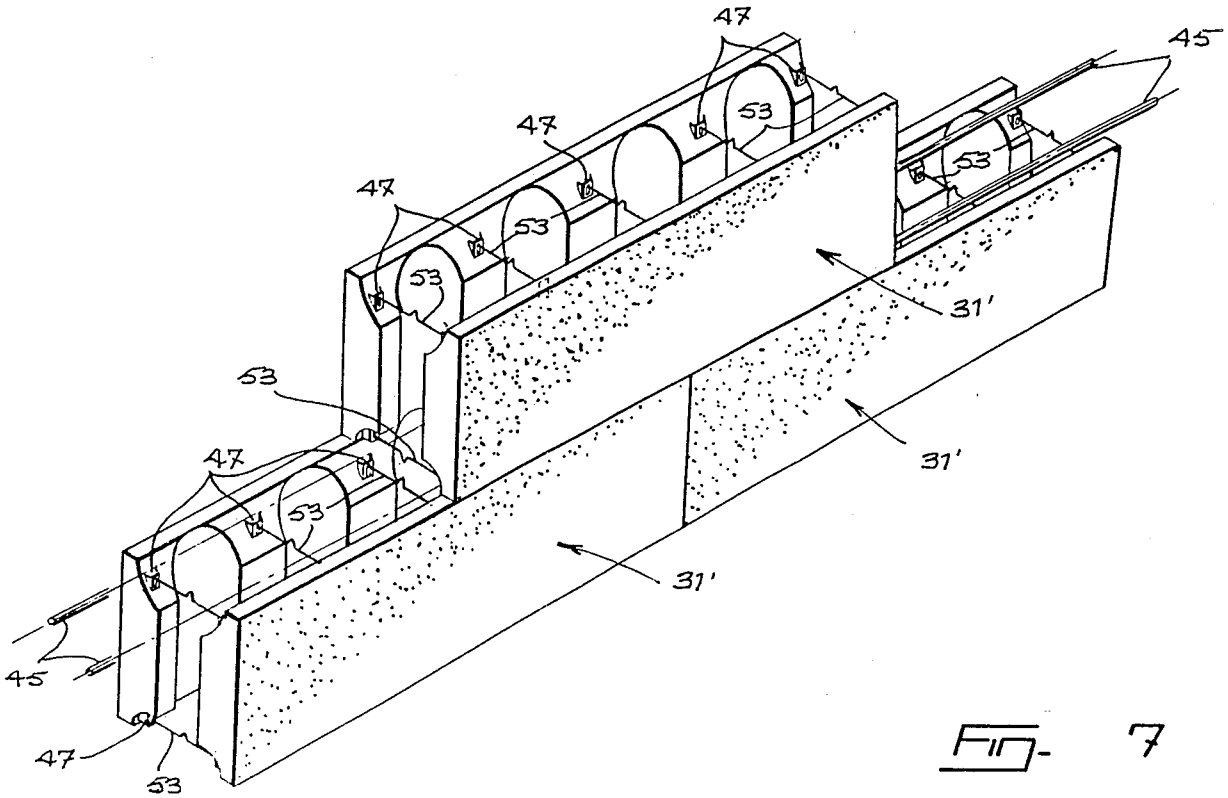
FIG. 7 is a view similar to that of FIG. 4 showing an alternative embodiment.

FIG. 4 shows the two sections 1 of each module 31 to be interconnected by resilient tie-rods 33, the assembly being made at the building site. The connection is best illustrated in FIG. 5. The resilient tie-rods 33 have hooked ends lockingly engaged into the hollowed ends of the tubular members 25 both at the top and at the bottom, in the notches 21, 23. Each hooked end is formed of an inner part 35, flatly engaging the bores of the hollowed ends of the tubular members 25, and an inclined terminal part 37 in edge abutting engagement with the bores so as to prevent accidental withdrawal of the rods 31 from the tubular members 25.

Figure 6:
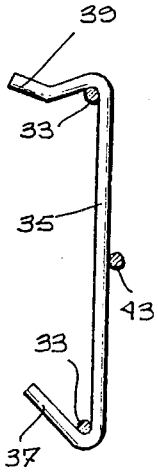
FIG. 6 is a side view of a coupling rod.

Resilient coupling rods 35 are used to prevent relative lifting of stacked modules 31 by interlocking engagement of adjoining pairs of tie-rods 33 at the bottom and at the top of the stacked modules. For this purpose, and as shown in FIG. 6, one end of each coupling rod 35 is bent at an acute angle to form a hook 37 adapted to firmly wind around the lower tie-rod 33 while the other end also bends in the same direction but far less sharply and then rises to form a smooth hooking elbow 39. In use, when the tie-rods 33 have first been appropriately positioned in the tubular members 25, the hook 37 is first wound around the lower tie-rod 33 and the hooked elbow 39 is then snapped over the higher tie-rod 33, as illustrated in FIG. 5. Preferably, the tie-rods 33 are bent slightly at their centers and toward one another to form nicks 41 adapted to receive the hooks 37 and the elbows 39, respectively. Reinforcement bar supports may advantageously be provided, in the form of the support rods 43 fixed at their centers to the centers of the coupling rods 35; the ends of the support rods 43 being bent in the form of triangular troughs 44 for the seating of reinforcement bars 45.

Figure 10:
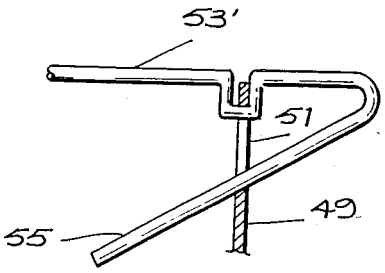
Figure 11:
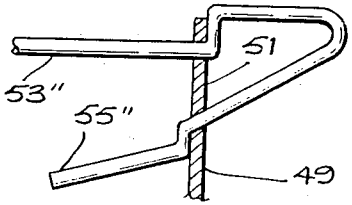
Figure 9:
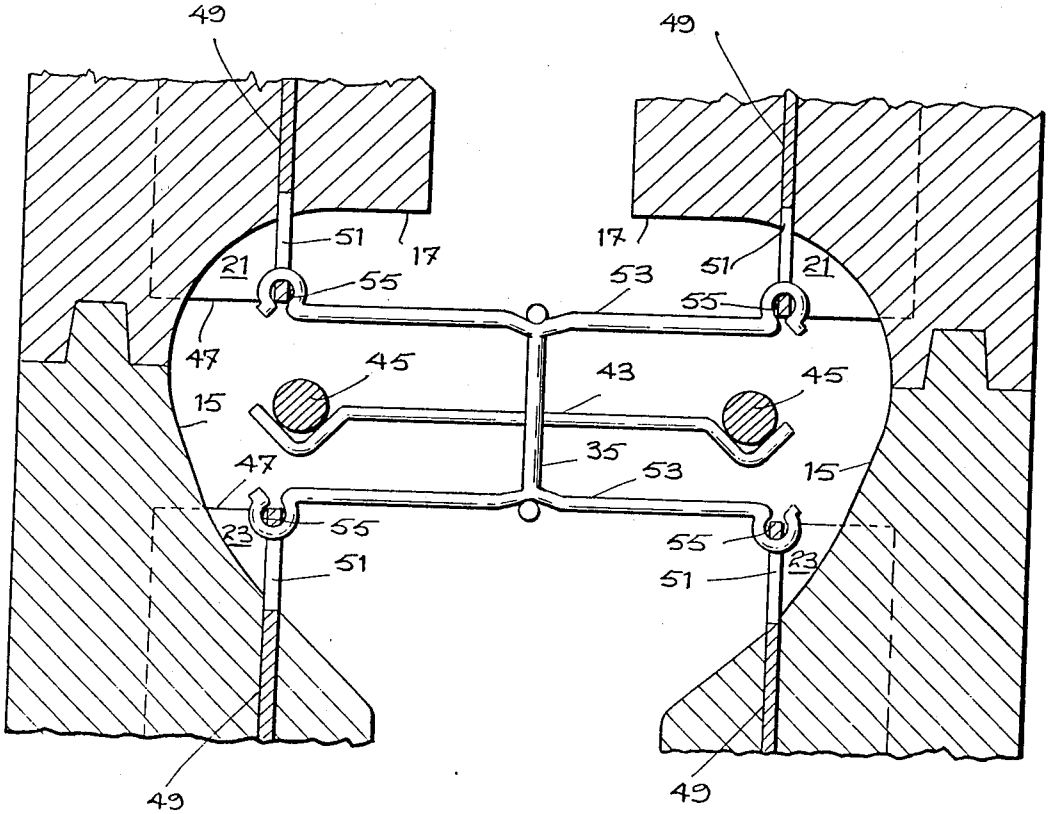
FIG. 9 is a view similar to that of FIG. 5 but for the embodiment of FIG. 7, and FIGS. 10 and 11 are alternative forms of tie-rods in the embodiment of FIG. 7.

In the embodiment of FIGS. 7, 8, 9, 10 and 11, the inserts embedded in the ribs 13 are channel-shaped members 47 of which the ends project into the notches 21, 23 or simply from the slopes 15, 17, of FIG. 3. The central web 49 of the members 47 is formed with holes 51, preferably elongated slots, one such hole being in each of the notches 21, 23, or immediately above the slopes 15, 17 of FIG. 3 In this case, the tie-rods 53 have hooked ends that define an open recess engaged over the solid portions of the webs 49 that circumscribe the holes 51. In FIG. 9, the open recess 55 is an open circle. In the variant of FIG. 10, the open recess in the tie-rod 53′ is U-shaped while in the tie-rod 53″, it is a rabbet. In both tie-rods 53′ and 53″, the terminal portions are bent over the main portions to provide flexible arms 55, 55′ creating a bias action to force the rods 53′, 53″, against the peripheral wall of the holes 51. The coupling rods 35 and support rods 43 are the same as in FIG. 5.

The foam plastic used in the molding of the module sections 1 is preferably expanded cellular polystyrene made according to ASTM D1692-59T. It should of course be homogenous throughout its mass and be free from any accumulation of unexpanded polystyrene particles as well as of any foreign particles.

Vertical reinforcement bars (not shown) may of course be driven through the concrete mix after pouring.

I claim:

1. A formwork module section, made of foam plastic material, said section being adapted to serve as one wall of a module of a formwork used in the molding of an insulated concrete wall, said section comprising:

(a) a panel having an outer face and an inner face, an upper edge and a lower edge;

(b) spaced ribs solid with said panel and projecting from said panel inner face between said edges, each of said ribs having an upper end and a lower end;

(c) insert embedded, each in one of said ribs, said inserts being formed with tie-rod receiving-and-locking apertures, said apertures being located at said upper and lower ends of said ribs and short of said panel upper and lower edges; and (d) said inserts being channel-shaped members having ends projecting beyond the upper and lower ends of said ribs, each channel-shaped member having a central web formed with holes through said member projecting ends, and said holes defining said tie-rods receiving-and-locking apertures.

2. A module section as claimed in claim 1, wherein said holes are elongated slots.

3. A module section as claimed in claim 1, wherein said ribs each has a longitudinal flat tip away from said inner face, wherein said ribs have slopes inclined inwardly from said panel edges toward said flat tips and wherein said ribs upper and lower ends are formed by notches cut through said slopes.

4. A formwork module comprising a pair of formwork module sections as claimed in claim 1, said sections being disposed in mirror position; said formwork module further comprising:

tie rods having hooked ends lockingly engaged into said holes, said hooked ends defining open recesses engaged over portions of said channel-shaped members circumbscribing said holes.

5. A formwork for making an insulated concrete wall and comprising a pair of modules as claimed in claim 4, stacked one upon the other with opening tie-rods thereof disposed one above the other, in pairs, said formwork further comprising:

coupling rods having hooked ends, said hooked ends interlocking with the tie-rods of said pairs of tie-rods for preventing vertical separation of said formwork modules as concrete is being poured into said formwork.

6. A formwork as claimed in claim 5, wherein said tie-rods of a pair slightly bend toward one another at the centers thereof to form nicks and said hooked ends of said coupling rods engage into said nicks.

7. A formwork as claimed in claim 5, further comprising reinforcing bar supports in the form of support rods fixed to said coupling rods between said tie-rods, the ends of said support rods being bent in the form of troughs for the lodging of reinforcement bars.

8. A formwork module for making an insulated concrete wall and comprising a pair of formwork module sections disposed in mirror position and stacked one upon the other comprising:

(a) each section including:

i. a panel having an outer face and an inner face, an upper edge and a lower edge, ii. spaced ribs solid with said panel and projecting from said panel inner face between said edges, each of said ribs having an upper end and a lower end, iii. inserts embedded, each in one of said ribs, said inserts being formed with tie-rod receiving-and-locking apertures, said apertures being located at said upper and lower ends of said ribs and short of said panel upper and lower edges, and iv. said inserts being tubular members having hollowed ends opening at the upper and lower ends of said ribs, said hollowed ends defining said ties-rod receiving-and-locking apertures;

(b) tie rods disposed one above the other, in pairs, adjoining each pair of modules, the tie rods having hooked ends lockingly engaged into said hollowed ends of said tubular members, said hooked ends being formed of an inner part, flatly engaging the bores of said hollow ends, and of an inclined terminal part in edge-butting engagement with said bores to prevent withdrawal of said tie-rods from said tubular members; and (c) coupling rods having hooked ends, said hooked ends interlocking with the tie-rod of said pairs of tie-rods for preventing vertical separation of said formwork modules as concrete is being poured into said formwork.

9. A formwork as claimed in claim 8, wherein said tie-rods of a pair slightly bend toward one another at the centers thereof to form nicks and said hooked ends of said coupling rods engage into said nicks.

10. A formwork as claimed in claim 8, further comprising reinforcing bar supports in the form of support rods fixed to said coupling rods between said tie-rods, the ends of said support rods being bent in the form of troughs for the lodging of reinforcement bars.

* * * * *